US005726370A

United States Patent [19]

Yanagisawa

[11] Patent Number: 5,726,370

[45] Date of Patent: Mar. 10, 1998

[54] HOOP CLAMPING SYSTEM FOR A BASS DRUM PEDAL ASSEMBLY

[75] Inventor: Mitsuo Yanagisawa, Chiba, Japan

[73] Assignee: Pearl Musical Instrument Co., Chiba, Japan

[21] Appl. No.: 581,486

[22] Filed: Dec. 29, 1995

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS

| | | | |
|---|---|---|---|
| 1,042,919 | 10/1912 | Hughes | 84/422.2 |
| 4,955,277 | 9/1990 | Carlson | 84/422.1 |
| 5,185,489 | 2/1993 | Hoshino | 84/422.1 |
| 5,297,467 | 3/1994 | Hoshino | 84/422.1 |
| 5,317,946 | 6/1994 | Hoshino | 84/422.1 |
| 5,343,792 | 9/1994 | Liao | 84/422.1 |
| 5,365,824 | 11/1994 | Hoshino | 84/422.1 |
| 5,379,674 | 1/1995 | Hoshino | 84/422.1 |
| 5,388,494 | 2/1995 | Hoshino | 84/422.1 |
| 5,398,584 | 3/1995 | Liao | 84/422.1 |
| 5,431,081 | 7/1995 | Lombardi et al. | 84/422.1 |

*Primary Examiner*—Michael L. Gellner
*Assistant Examiner*—Shih-yung Hsich
*Attorney, Agent, or Firm*—Longacre & White

[57] ABSTRACT

The hoop clamping system for bass drum assemblies features an assembly attached to the foot pedal's floor plate into which the handle bolt is attached and made easily accessible from the side of the pedal. The toe clamp is activated by a pivoting cam, one end of which is under the heel of the toe clamp; the other in contact with the handle bolt. Turning the handle bolt causes the cam to lift or lower the heel of the toe clamp resulting in the desired clamping action. This hoop clamp system provides greater range of travel for the foot board, and substantially improves accessibility to the handle bolt for ease of adjusting the toe clamp. This hoop clamping system further reduces unwanted vibration and lowers manufacturing costs.

13 Claims, 6 Drawing Sheets

HOOP CLAMPING SYSTEM FOR A BASS DRUM PEDAL ASSEMBLY

BACKGROUND OF THE INVENTION

1. Field of the Invention

The present invention relates to a foot operated pedal assembly for a bass drum, and more particularly to a drum hoop clamping assembly which is removably attached to the drum pedal floor plate which provides a greater range of travel of the foot board and substantially improved accessibility to the handle bolt for ease of adjusting the toe clamp.

2. Description of the Prior Art

Footpedals used to play bass drums used in musical instrument drum sets commonly have a device known as a toe clamp or hoop clamp to affix the footpedal to the drum's hoop. Named for its appearance, having a heel and toe, the toe clamp pivots on an axle giving it a rocking motion similar to a playground seesaw. Commonly, a handle bolt is threaded into the heel of the toe clamp and rotation of the handle bolt raises or lowers the heel relative to the base of the pedal which in turn raises or lowers the toe of the toe clamp.

As shown in prior art FIG. 1, a prior art hoop clamping structure for a bass drum includes a toe or hoop clamp 71 on a drum pedal device 70 and the clamp 71 engages the drum head hoop 62 which is provided on the drum body 61 of the bass drum 60. The toe clamp 71 is pivoted by a T bolt 72, which secures the drum pedal 70 to the bass drum 60. The pedal operated drum beater is supported on a base 74, and the beater is operated by a foot pedal plate 75.

The prior art hoop clamping system has several drawbacks, such as, the handle bolt extends directly into the path of the footboard and depending on the travel setting of the footboard, the footboard can sometimes collide with the handle bolt or T bolt resulting in damage to one or both pieces. In addition, the mechanism is nested next to the pedal's frame and below the footboard, thus making access to the handle bolt awkward and difficult. Also, due to vibration of the drum, the screw gradually loosens, and the foot pedal can separate from the drum.

Prior art FIG. 2 illustrate a second conventional design of a quick connect hoop clamping system wherein a clamp 87 is pivotally attached to the foot pedal of a drum, and a cam 81 is used to rotate the clamp 87. In addition to the quick connect lever 83, an adjusting screw 84 is used to adjust the space between the cam 81 and the clamp 87 to set the clamping pressure for the drum hoop. However, because the lever 83 and adjusting screw 84 are positioned on the bottom side of the foot board, the rotation of the screw is difficult, as with the design of FIG. 1.

In a third prior art design as shown in FIG. 3, a hoop clamping system is design with a cam 95 installed to rotate freely on the frame 96 with the cam face 95*a* directly connected to the clamp 97 to rotate the clamp. The cam 95 is rotated by an adjusting screw 93 mounted to the frame 96. The rotating portion of one end 93*a* of this screw is stretched to the outside of the frame 96, while the other end 93*b* is directly connected to the previously mentioned cam 95. Because the screw 93 extends beyond the frame 96 and away from the path of the foot board 91, the adjusting screw 93 is more accessible than the designs of FIGS. 1 and 2. However, the design of FIG. 3 still suffers from the drawback in that the adjustment screw loosens during use due vibration during use. Moreover, the manufacturing costs of the design of FIG. 3 are unnecessarily high because the hoop clamping structure is integrally formed with the frame 96.

The need therefore exists for a hoop clamping system which is easily accessible and which is shielded from the vibrational drawbacks inherent in the prior art designs. Moreover, the need exists for a hoop clamping system which is formed separately from the base and lateral support members of the beater mechanism, thereby reducing manufacturing costs and further reducing vibrational influences.

SUMMARY OF THE INVENTION

It is the object of this invention to provide a foot operated bass drum pedal hoop clamp system which allows greater range of travel of the footboard, and substantially improves accessibility to the handle bolt for ease of adjusting the toe clamp.

It is further the object of the present invention to provide a hoop clamping system which is formed separately from the base and lateral support members of the beater mechanism, thereby reducing manufacturing costs and vibrational influences.

The improved hoop clamping system features an assembly removably attached to the foot pedal's floor plate into which the handle bolt is attached and made easily accessible from the side of the pedal. The toe clamp is activated by a pivoting cam, one end of which is under the heel of the toe clamp; the other end being in contact with the handle bolt. Turning the handle bolt causes the cam to lift or lower the heel of the toe clamp resulting in the clamping of the hoop assembly of the bass drum.

Other and further objects, features and advantages of the invention will appear more fully from the following description with reference to the drawings.

DESCRIPTION OF THE PREFERRED EMBODIMENT

Figure 1:
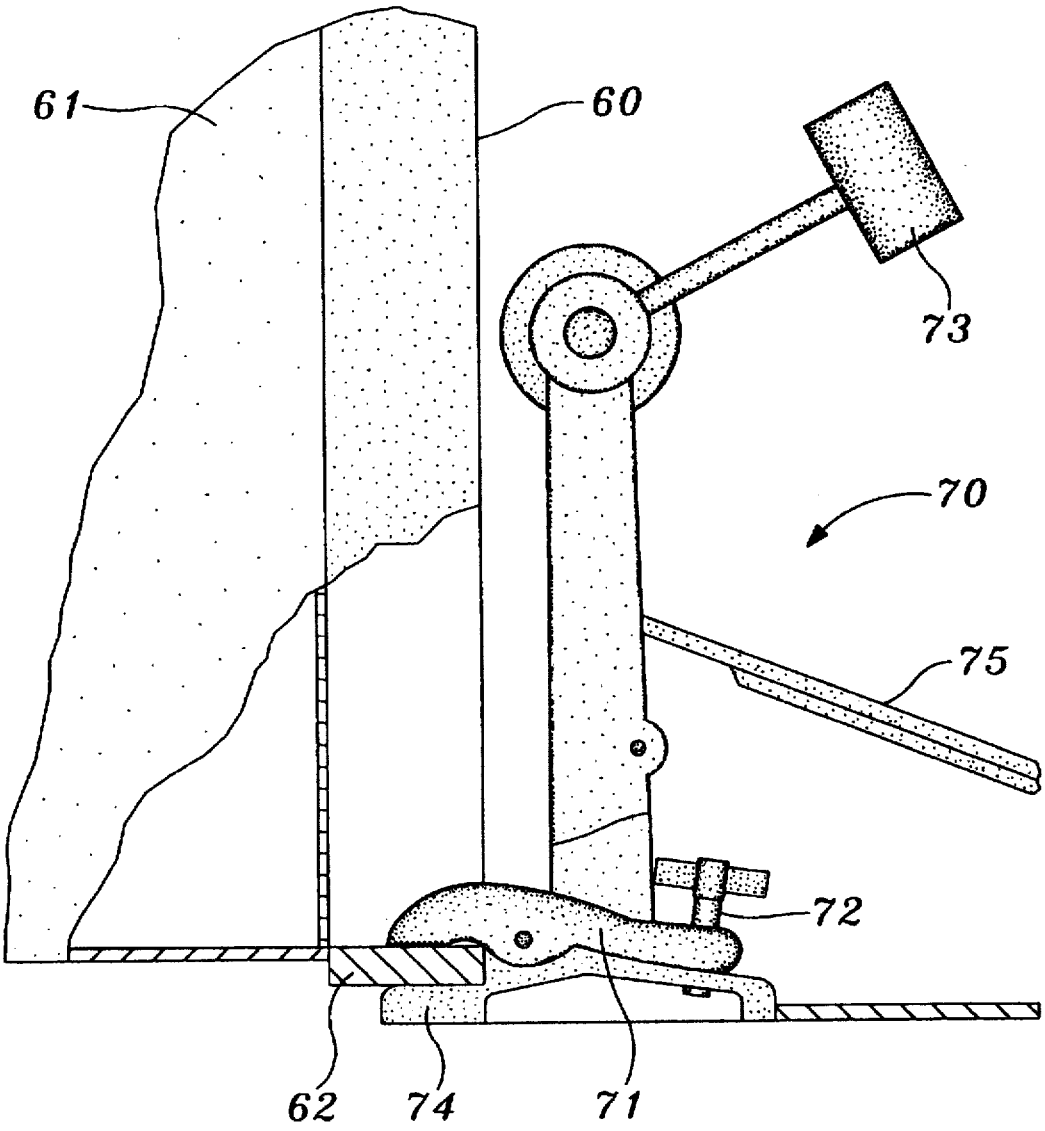
FIG. 1 PRIOR ART
FIG. 1 is a side view of a prior art hoop clamping systems.
Figure 2:
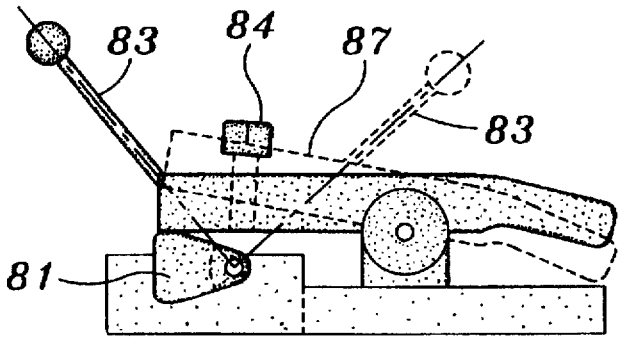
FIG. 2 PRIOR ART
FIG. 2 is a side view of a second prior art hoop clamping system having a quick connect lever.
Figure 3:
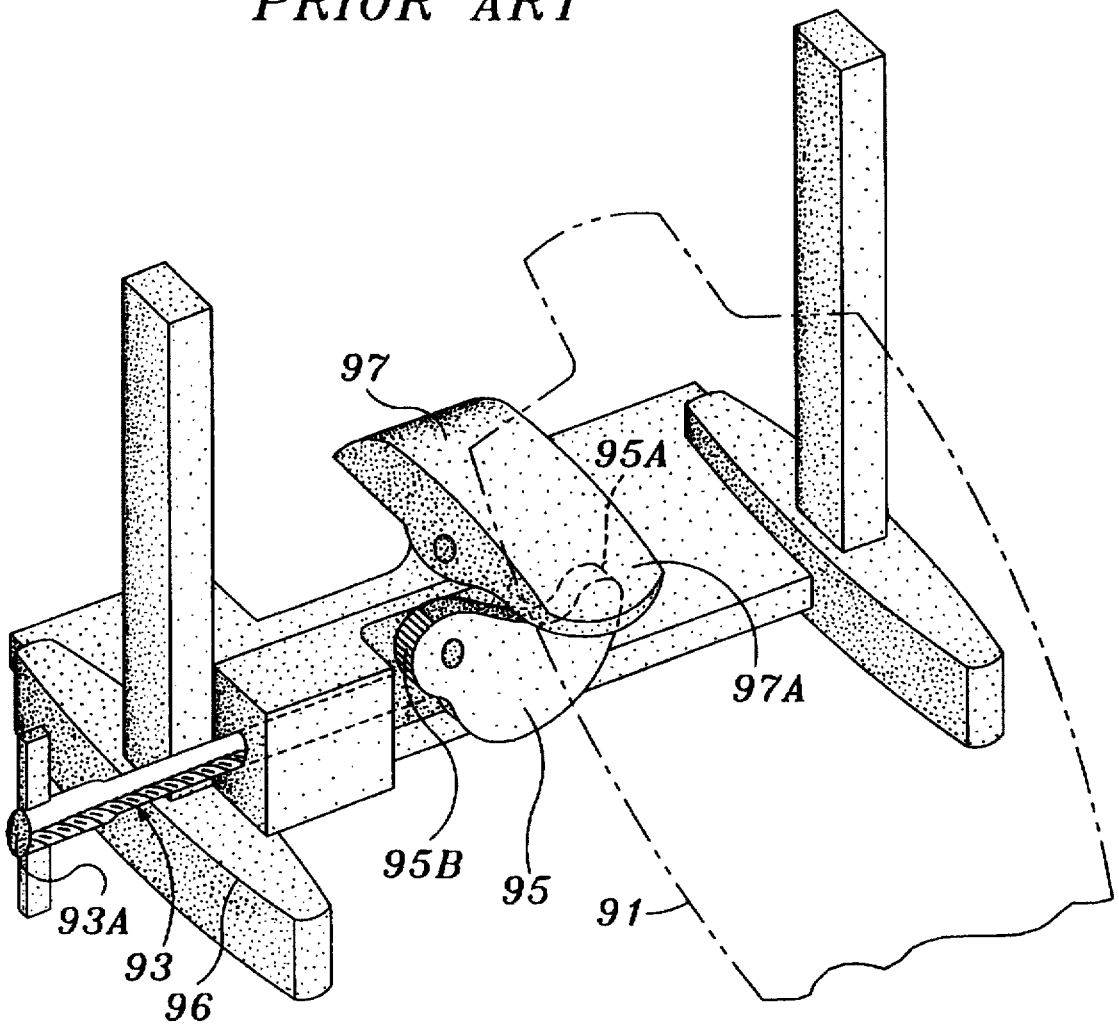
FIG. 3 PRIOR ART
FIG. 3 is a perspective view of a further prior art hoop clamping system in which an adjusting screw extends beyond the frame of the foot pedal assembly.
Figure 4:
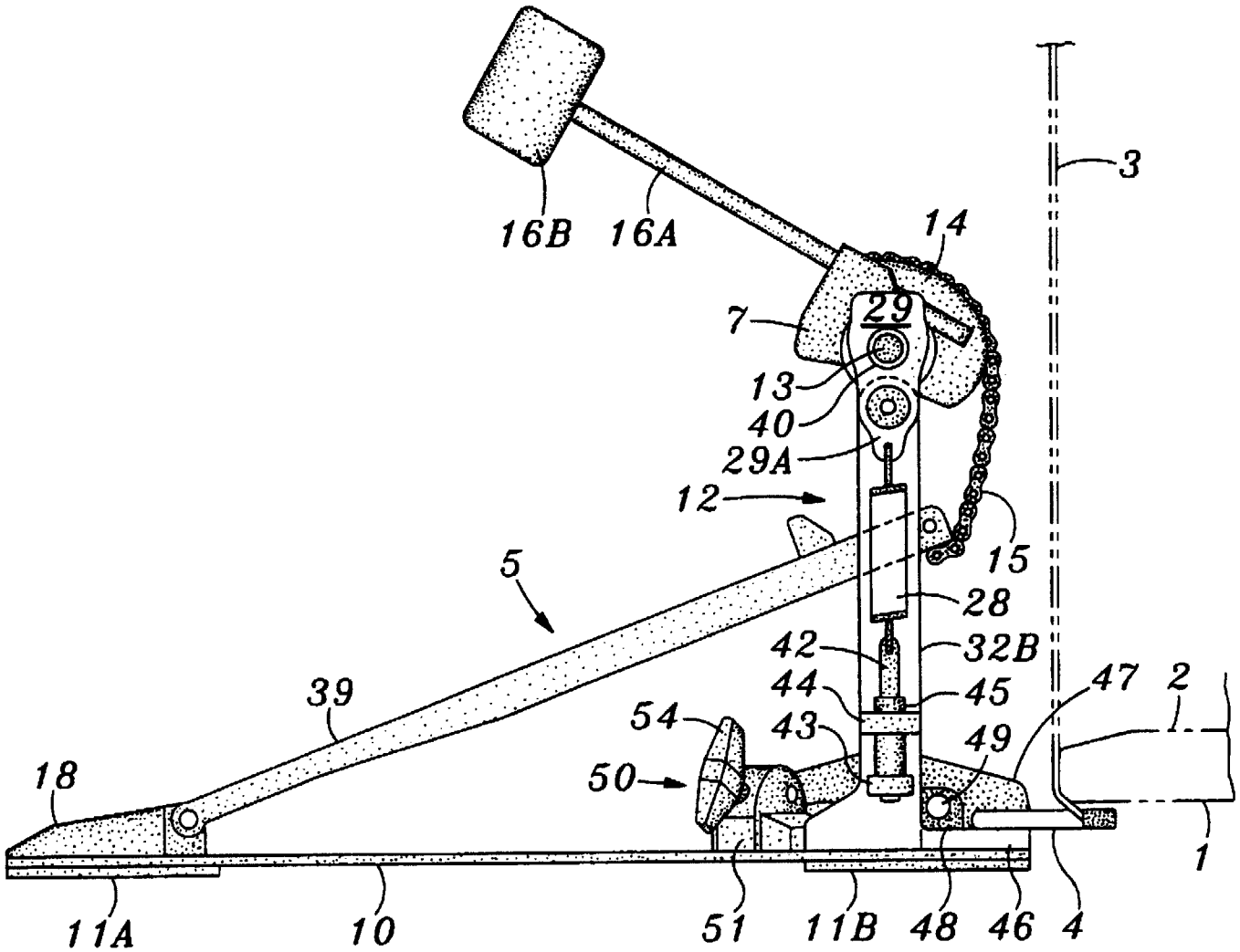
FIG. 4 is a side view of the hoop clamping system of the invention as mounted on the foot pedal arrangement and base plate assembly.
Figure 5:
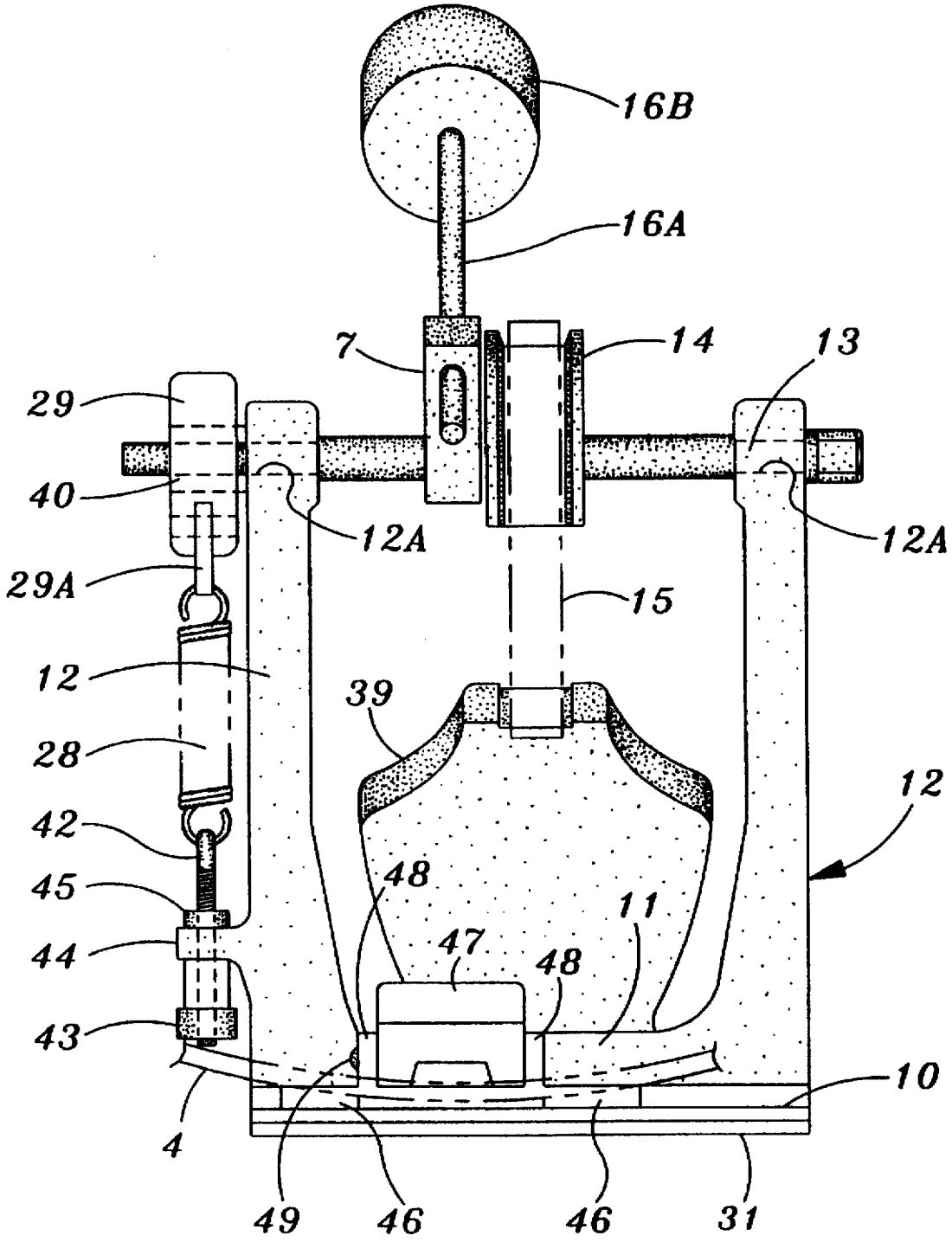
FIG. 5 is front view of the foot pedal assembly of this invention as viewed from the drum.

Referring now to the drawings, the bass drum pedal arrangement is depicted generally at 5 in FIGS. 4 and 5. The pedal comprises right and left upstanding support members 12. The support members 12 are separated by a cross member 11 deposed between the lower portions of the upstanding support members 12, typically being integrally formed therewith. The two support members 12 each have an aperture 12*a* coaxially aligned at their upper ends to support a rotating shaft 13 deposed therebetween. The rotating shaft 13 extends beyond one of the upstanding support members 12 to support a return lever 29. In the preferred embodiment, a cylindrical sleeve 40 is fixedly mounted about shaft 13, where the shaft 13 extends from the right upstanding support member 12. The return lever 29 is then in turn mounted about the cylindrical sleeve 40.

Mounted on the rotating shaft 13, between the support members 12 are a collar 7 and a wheel 14. The wheel 14 is driven by a chain 15 such that when tension is applied to the chain, the wheel and consequently the rotating shaft rotate. The collar 7 supports a hammer shaft **16*a* and a hammer 16*b* such that rotation of the shaft 13 causes the hammer shaft 16*a* and hammer 16*b* to move towards the drum's membrane 3. The collar 7 may be equipped with an adjustment bracket to secure the hammer-shaft 16*a* extending varying lengths from the collar 7**.

A bracket 44, which extends outwardly from the lower portion of one of the support members 12, has an aperture to receive an adjustment bolt 42. A cinch nut 45 threadably engages the adjustment bolt 42 and is positioned above the bracket 44. An adjustment nut 43 threadably engages the adjustment bolt and is positioned just below the bracket 44. A link member **29*a* is rotatably mounted to the return lever 29 extending downwardly toward the adjustment bolt 42. A return coil spring 28 is attached to and interposed between the link member 29*a* and adjustment bolt 42**.

The two support members 12, cross member 11 and heel piece assembly 18 are mounted on top of a base plate 10. Base plate 10 extends forwardly towards the bass drum and is tapered rearward to the heel piece assembly 18. The base plate 10 is in turn mounted on top of two friction pads **11*a* and 11*b*. Friction pad 11*b* extends from the forward most portion of the base plate rearwardly past the upstanding support members and friction pad 11*a*** extends from the rearward most portion of the base plate forward past the heel piece. These pads help prevent the pedal assembly from slipping on the floor during use, and help to reduce unwanted vibration.

A toe clamp 47 is mounted on top of the base plate 10, transverse to the cross member 11, centrally deposed between the upstanding support members 12. In the preferred embodiment the clamp member 47 pivotally mounted between support members 12 atop the cross member 11. Right and left clamp hinge supports 48 are disposed on both sides of toe clamp 47, spaced apart adjacent to the cross member 11. Each clamp hinge support 48 has a coaxially aligned aperture receiving a pintle 49. The toe clamp 47 is deposed between clamp hinge supports 48 extending forwardly toward the bass drum and rearwardly toward the heel piece assembly 18. The pivoting toe clamp 47 pivots to provide a clamping means for the hoop 4 of the drum (partially shown in FIG. 4).

Figure 6:
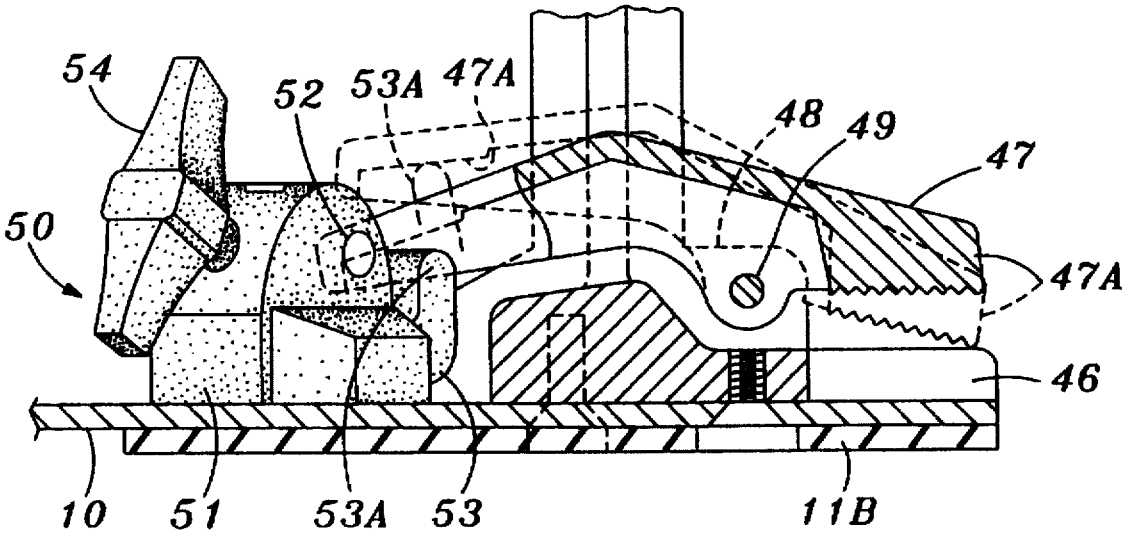
FIG. 6 is a partial side view of the clamp adjustment member and toe clamp assembly of this invention.
Figure 7:
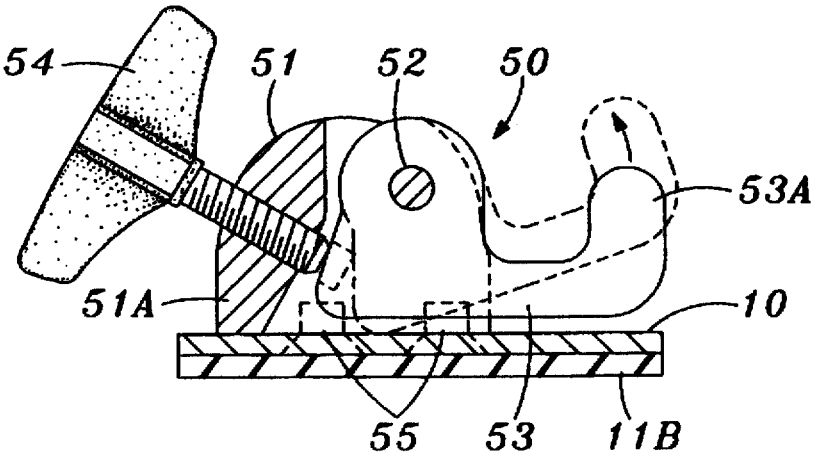
FIG. 7 is a side view of the clamp adjustment member of this invention as mounted on the base plate and friction pad.
Figure 8:
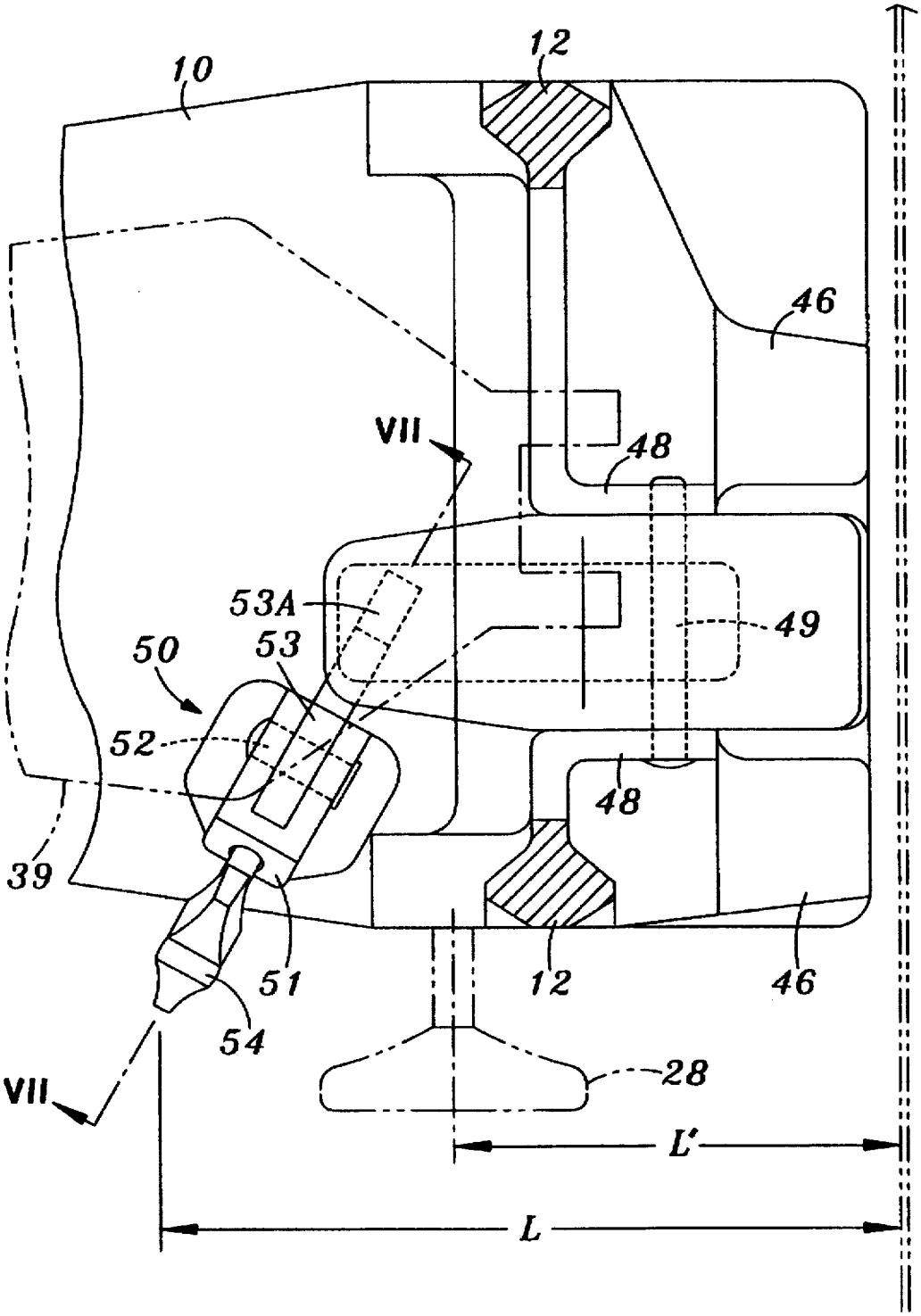
FIG. 8 is a partial top view of the hoop clamping assembly of this invention as mounted on the foot pedal assembly.

With reference to FIGS. 6–8, the clamp adjustment member 50 is mounted atop base plate 10 rearward of support members 12. A number of screws 55 pass through the friction pad **11*b* to threadingly secure the clamp adjustment member 50 to the base plate 10. By simply removing the screws 55, the clamp adjustment member 50 may be removed from the assembly. This feature provides substantial benefit if the hoop clamping assembling becomes worn or damaged. A clamp screw 54 threadably engages and passes through the clamp base 51 to engage the pivoting cam member 53 such that when the screw 54 is tightened the pivoting cam member 53 rotates about the pin 52. As shown in FIGS. 6 and 7, upon rotation of the cam member 53 the shoulder 53*a* is raised against one end of the toe clamp 47, thereby adjusting the clamping force of the toe clamp 47 on the hoop 4. When the screw is loosened the pivot arm rotates so as to release hoop 4. FIG. 6 illustrate the movement of the pivoting cam member 53 and the toe clamp 47. The resultant clamping effect is shown at the forward end 47*a* of the toe clamp 47; the spacing between the forward tip 47*a* and the leg(s) 46 which rest under the hoop 4 of the drum (see FIGS. 4, 6 and 8**).

FIG. 8 further illustrates one advantage provided by the present invention, wherein the clamp screw 54 is positioned further from the drumhead 3 than the adjustment screw of the prior art which is shown in phantom at 28 (see distances L and L'). The clamp screw 54 preferrably extends at an angle of about 30 degrees with respect to a plane defined by the support members 12.

While the hoop clamping assembly of this invention has been shown and described with reference to a particular embodiment, it will be understood to those possessing skill in the art that various changes to the form and detail may be made therein without departing from the spirit and scope of the invention.

I claim:

1. A drum foot pedal device for clamping a foot pedal assembly to a drum, the drum having a membrane and a shell with a drum hoop, and the foot pedal assembly having upstanding support members supporting a rotating beater member for beating said membrane of said drum, wherein the rotating beater is activated by a foot pedal pivotally mounted on a base plate by a heel member, said foot pedal device comprising:

a toe clamp pivotally mounted on a base portion of said foot pedal assembly, said base portion being integrally formed with said upstanding support members, and said toe clamp adapted to clamp said drum hoop to retain said foot pedal assembly relative to said drum;

a clamp adjusting member removably affixed to a base plate and separate from said base portion, said base plate extending from said base portion to said heel member, said clamp adjusting member comprising a pivoting cam member and an adjustment means for acting on said pivoting cam member to adjust a clamping force of said toe clamp.

2. The drum foot pedal device of claim 1, wherein said pivoting cam member is supported on said clamp adjusting member and pivots in response to movement of said adjustment means.

3. The drum foot pedal device of claim 1, wherein said clamp adjusting member removably retained on said base plate by an affixing means, wherein said adjusting member is separated from said base plate and said base portion upon disengagement of said affixing means.

4. The drum foot pedal device of claim 1, wherein said foot pedal pivots along a pivot plane, said adjustment means projecting away from said pivot plane of said foot pedal to permit a musician to access said adjustment means during movement of said foot pedal.

5. The drum foot pedal device of claim 1, further comprising at least one friction pad located adjacent to said base plate, said friction pad preventing slip of said foot pedal assembly during use.

6. The drum foot pedal device of claim 1, wherein said clamp adjusting member is remotely located with respect to said base portion and said upstanding support members.

7. A drum foot pedal device for clamping a foot pedal assembly to a drum, the drum having a membrane and a shell with a drum hoop, and the foot pedal assembly having upstanding support members supporting a rotating beater member for beating said membrane of said drum, wherein the rotating beater is activated by a foot pedal pivotally mounted on a base plate by a heel member, said foot pedal device comprising:

a toe clamp pivotally mounted on a base portion of said foot pedal assembly, said base portion being integrally formed with said upstanding support members, and said toe clamp adapted to clamp said drum hoop to retain said foot pedal assembly relative to said drum;

a clamp adjusting member removably mounted on a base plate and separate from said base portion, said base plate extending from said base portion to said heel member, said clamp adjusting member comprising adjustment means for adjusting a clamping force of said toe clamp, wherein said adjustment means comprises a screw member threading disposed on said clamp adjustment member, said screw member acting on an end of a pivoting cam member supported on said clamp adjusting member.

8. A drum foot pedal device for beating a membrane of a drum, the drum having a membrane and a shell with a drum hoop, said foot pedal assembly comprising:

an elongated base plate extending away from said drum;

upstanding support members supporting a rotating beater member for beating said membrane of said drum;

a foot pedal pivotally mounted on said base plate by a heel member, the rotating beater being activated by said foot pedal:

a toe clamp pivotally mounted on a base portion integrally formed with said upstanding support members, and said toe clamp adapted to clamp said drum hoop to retain said foot pedal assembly in a fixed position relative to said drum;

a clamp adjusting member removably mounted on said base plate at a position remote from said base portion, said clamp adjusting member comprising a plate member removably affixed to said base plate, a pivoting cam member mounted on said plate member, and an adjustment means for acting on said pivoting cam member to adjust a clamping force of said toe clamp.

9. The drum foot pedal device of claim 8, wherein said pivoting cam member is supported on said clamp adjusting member and pivots in response to movement of said adjustment means.

10. The drum foot pedal device of claim 8, wherein said clamp adjusting member removably retained on said base plate by an affixing means, wherein said adjusting member is separated from said base plate and said base portion upon disengagement of said affixing means.

11. The drum foot pedal device of claim 10, wherein said affixing means comprises at least one screw member threadingly engaging said base plate and said clamp adjusting member.

12. The drum foot pedal device of claim 8, wherein said foot pedal pivots along a pivot plane, said adjustment means projecting away from said pivot plane of said foot pedal to permit a musician to access said adjustment means during movement of said foot pedal.

13. A drum foot pedal device for beating a membrane of a drum, the drum having a membrane and a shell with a drum hoop, said foot pedal assembly comprising:

an elongated base plate extending away from said drum;

upstanding support members supporting a rotating beater member for beating said membrane of said drum;

a foot pedal pivotally mounted on said base plate by a heel member, the rotating beater being activated by said foot pedal:

a toe clamp pivotally mounted on a base portion integrally formed with said upstanding support members, and said toe clamp adapted to clamp said drum hoop to retain said foot pedal assembly in a fixed position relative to said drum;

a clamp adjusting member removably mounted on said base plate at a position remote from said base portion, said clamp adjusting member comprising adjustment means for adjusting a clamping force of said toe clamp, wherein said adjustment means comprises a screw member threading disposed on said clamp adjustment member, said screw member acting on an end of a pivoting cam member supported on said clamp adjusting member.

* * * * *